US009620040B2

(12) United States Patent
Kaytes

(10) Patent No.: US 9,620,040 B2
(45) Date of Patent: Apr. 11, 2017

(54) AERIAL ADVERTISING DISPLAY APPARATUS

(71) Applicant: Bennett R. Kaytes, Sunny Isles, FL (US)

(72) Inventor: Bennett R. Kaytes, Sunny Isles, FL (US)

( * ) Notice: Subject to any disclaimer, the term of this patent is extended or adjusted under 35 U.S.C. 154(b) by 36 days.

(21) Appl. No.: 14/644,636

(22) Filed: Mar. 11, 2015

(65) Prior Publication Data

US 2016/0146397 A1 May 26, 2016

Related U.S. Application Data

(60) Provisional application No. 61/951,250, filed on Mar. 11, 2014.

(51) Int. Cl.
*G09F 21/04* (2006.01)
*G09F 15/00* (2006.01)
(Continued)

(52) U.S. Cl.
CPC ..... *G09F 21/04* (2013.01); *B65F 1/12* (2013.01); *B65F 1/122* (2013.01); *B65F 3/0203* (2013.01); *B66C 13/005* (2013.01); *G09F 15/00* (2013.01); *G09F 15/0018* (2013.01); *G09F 15/0037* (2013.01); *G09F 15/0087* (2013.01); *G09F 19/22* (2013.01); *B65F 2003/0266* (2013.01); *G09F 2007/1865* (2013.01)

(58) Field of Classification Search
CPC .. G09F 21/04; G09F 2007/1865; G09F 15/00; B65F 1/122; B65F 1/12; B65F 3/0203; B65F 2003/0266
See application file for complete search history.

(56) References Cited

U.S. PATENT DOCUMENTS 4,110,792 A 8/1978 Long et al.
4,438,580 A 3/1984 Yamaji et al.
(Continued)

FOREIGN PATENT DOCUMENTS

DE 3606724 A1 * 9/1987 ..... B66C 13/005

OTHER PUBLICATIONS

Digital image of a website (canstockphoto.com) selling a photo of a Billboard on a Crane Boom.
(Continued)

*Primary Examiner* — Eret McNichols
(74) *Attorney, Agent, or Firm* — Glenn E. Gold; Glenn E. Gold, P.A.

(57) ABSTRACT

An aerial advertising display apparatus includes a support base for placing on a support surface, a lift mechanism mounted on the support base and being actuatable to change the elevation of an upper end of the lift mechanism above the support surface, and an attachment mechanism supported by the upper end portion of the lift mechanism. The attachment mechanism includes a forward component attached to an advertising display mounting frame and a rearward component attached to the upper end portion of the lift mechanism. The forward and rearward components are configured to interfit with one another so as to attach with and detach from one another to correspondingly couple and decouple the advertising display mounting frame to and from the upper end portion of the lift mechanism.

15 Claims, 16 Drawing Sheets

(51) Int. Cl.

| | |
|---|---|
| ***B65F 1/12*** | (2006.01) |
| ***B65F 3/02*** | (2006.01) |
| ***G09F 19/22*** | (2006.01) |
| ***B66C 13/00*** | (2006.01) |
| *G09F 7/18* | (2006.01) |

(56) References Cited

U.S. PATENT DOCUMENTS

| | | | | |
|---|---|---|---|---|
| 4,495,719 | A | 1/1985 | Futatsuishi et al. | |
| 5,249,833 | A | 10/1993 | Kobayashi | |
| 5,330,308 | A * | 7/1994 | Armando | B65F 3/046 294/119.1 |
| 5,542,203 | A * | 8/1996 | Luoma | G09F 13/04 340/908 |
| 6,101,750 | A * | 8/2000 | Blesener | G09F 13/04 340/815.53 |
| 6,150,996 | A * | 11/2000 | Nicholson | G09F 9/33 345/1.3 |
| 6,336,565 | B1 * | 1/2002 | Merkel | B66F 9/061 212/168 |
| 6,750,829 | B2 * | 6/2004 | Luoma | G06F 3/147 345/1.1 |
| 8,595,965 | B2 | 12/2013 | Sipperley et al. | |
| 9,015,972 | B1 * | 4/2015 | Morgan | G09F 21/048 40/209 |
| 9,117,378 | B2 * | 8/2015 | Sipperley | B61D 3/16 |
| 9,311,833 | B2 * | 4/2016 | George, II | G09F 21/04 |
| 2004/0016158 | A1 | 1/2004 | Kim | |
| 2006/0218037 | A1 * | 9/2006 | Rogers | B65F 1/122 705/308 |

OTHER PUBLICATIONS

Digital image of a website (xxjcy.com) showing a Truck Mounted LED display sign.

* cited by examiner 148
148
148

600

600

AERIAL ADVERTISING DISPLAY APPARATUS

CROSS REFERENCE TO RELATED APPLICATIONS

This U.S. Non-Provisional Patent Application claims the benefit of U.S. Provisional Patent Application No. 61/951,250, filed Mar. 11, 2014, which is incorporated-by-reference herein in its entirety.

FIELD OF THE INVENTION

The present invention relates to billboard displays, and more particularly, is concerned with an aerial advertising display apparatus.

BACKGROUND OF THE INVENTION

Some advertising displays, such as outdoor billboards, are typically large structures installed on a permanent basis in high traffic areas alongside streets and highways. They are commonly provided in a twelve feet by twenty-four feet size.

Other advertising displays generally of reduced sizes and shapes, compared to outdoor billboards, are frequently used at local events and attractions, such as fairs, festivals, retail establishments and sporting events. Many of these may be placed at these locations on a temporary basis on mobile carts and trailers.

An important advantage of outdoor billboard advertising displays over these other smaller advertising displays is the greater success that outdoor billboard advertising displays have in attracting and catching the attention of passing pedestrians and drivers. This is likely due to their greater height placement and enhanced visibility. However, the permanency of installation of outdoor billboard advertising displays is likely one factor in unduly limiting the scope of their potential utilization.

Accordingly, there remains a need in the art for an innovation that will overcome the deficiencies of past approaches and the problems that remain unsolved.

SUMMARY OF THE INVENTION

The present invention is directed to an innovation that overcomes the deficiencies of the past approaches and the problems that remain unsolved by providing an aerial advertising display apparatus. The apparatus incorporates a ground-supported platform or base, which may be mobile, with a lift mechanism mounted thereon, and an attachment mechanism for quickly and easily attaching and detaching a mounting frame of an advertising display to and from the lift mechanism. The mounting frame may support a conventional two-dimensional billboard, or a more customized three-dimensional object, such as artistic representations of brands and logos.

Thus, in one aspect of the present invention, an aerial advertising display apparatus includes:

- a support base for placing on a support surface;
- a lift mechanism mounted on the base and being actuatable to change the elevation of an upper end of the lift mechanism above the support surface; and
- an attachment mechanism supported by the upper end portion of the lift mechanism, the attachment mechanism including
  - a forward component attached to and disposed rearwardly of an advertising display mounting frame, and
  - a rearward component attached to the upper end portion of the lift mechanism, the forward and rearward components being configured to interfit with one another so as to attach with and detach from one another to correspondingly couple and decouple the advertising display mounting frame to and from the upper end portion of the lift mechanism.

In another aspect of the present invention, a mobile aerial advertising display apparatus includes:

- a ground-supported mobile chassis;
- a lift mechanism comprising a telescopic boom supported on the mobile chassis and being actuatable to undergo rotational movement in clockwise and counterclockwise directions horizontally and vertically relative to the mobile chassis so as to change the elevation of an upper end portion of the lift mechanism above the ground; and
- an attachment mechanism supported by the upper end portion of the lift mechanism, the attachment mechanism including
  - a forward component attached to and disposed rearwardly of an advertising display mounting frame, the forward component including a pair of rearwardly-projecting elongated tubular members being laterally spaced apart and extending fore-and-aft and parallel to one another, and
  - a rearward component attached to the upper end portion of the lift mechanism, the rearward component including a pair of forwardly-projecting tines configured to slidably insert into the rearwardly-projecting elongated tubular members of the forward component such that the forward and rearward components interfit with one another so as to attach with and detach from one another to correspondingly couple and decouple the advertising display mounting frame to and from the upper end portion of the lift mechanism.

In another aspect of the present invention, a mobile aerial advertising display apparatus includes:

- a ground-supported mobile chassis;
- a lift mechanism comprising a telescopic upright channel structure mounted to the mobile chassis and being actuatable to change the elevation of an upper end portion of the lift mechanism above the ground; and
- an attachment mechanism supported by the upper end portion of the lift mechanism, the attachment mechanism including
  - a forward component attached to and disposed rearwardly of an advertising display mounting frame, the forward component including a pair of rearwardly-projecting elongated tubular members being laterally spaced apart and extending fore-and-aft and parallel to one another, and
  - a rearward component attached to the upper end portion of the lift mechanism, the rearward component including a pair of forwardly-projecting tines configured to slidably insert into the rearwardly-projecting elongated tubular members of the forward component such that the forward and rearward components interfit with one another so as to attach with and detach from one another to correspondingly couple and decouple the advertising display mounting frame to and from the upper end portion of the lift mechanism.

In another aspect of the present invention, the attachment mechanism further includes a plurality of fasteners insertable through a plurality of apertures defined in the tubular members of the forward component and aligned with a plurality of apertures defined in the tines of the rearward component when the tubular members and tines are interfitted with one another.

In another aspect of the present invention, the forward component of the attachment mechanism further includes a mounting structure attached at a rear side to forward ends of the tubular members such that the mounting structure is configured at a front side to detachably attach to the advertising display mounting frame.

In another aspect of the present invention, the mounting structure of the forward component of the attachment mechanism is an elongated beam extending in a transverse relationship to, and being attached at the rear side to the forward ends of, the tubular members, the elongated beam having a plurality of plates attached on, and projecting forwardly from, the front side of said beam, said plates being attached respectively to sides of a plurality of laterally spaced apart upright members of the advertising display mounting frame.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION OF EXEMPLARY IMPLEMENTATIONS

Figure 1:
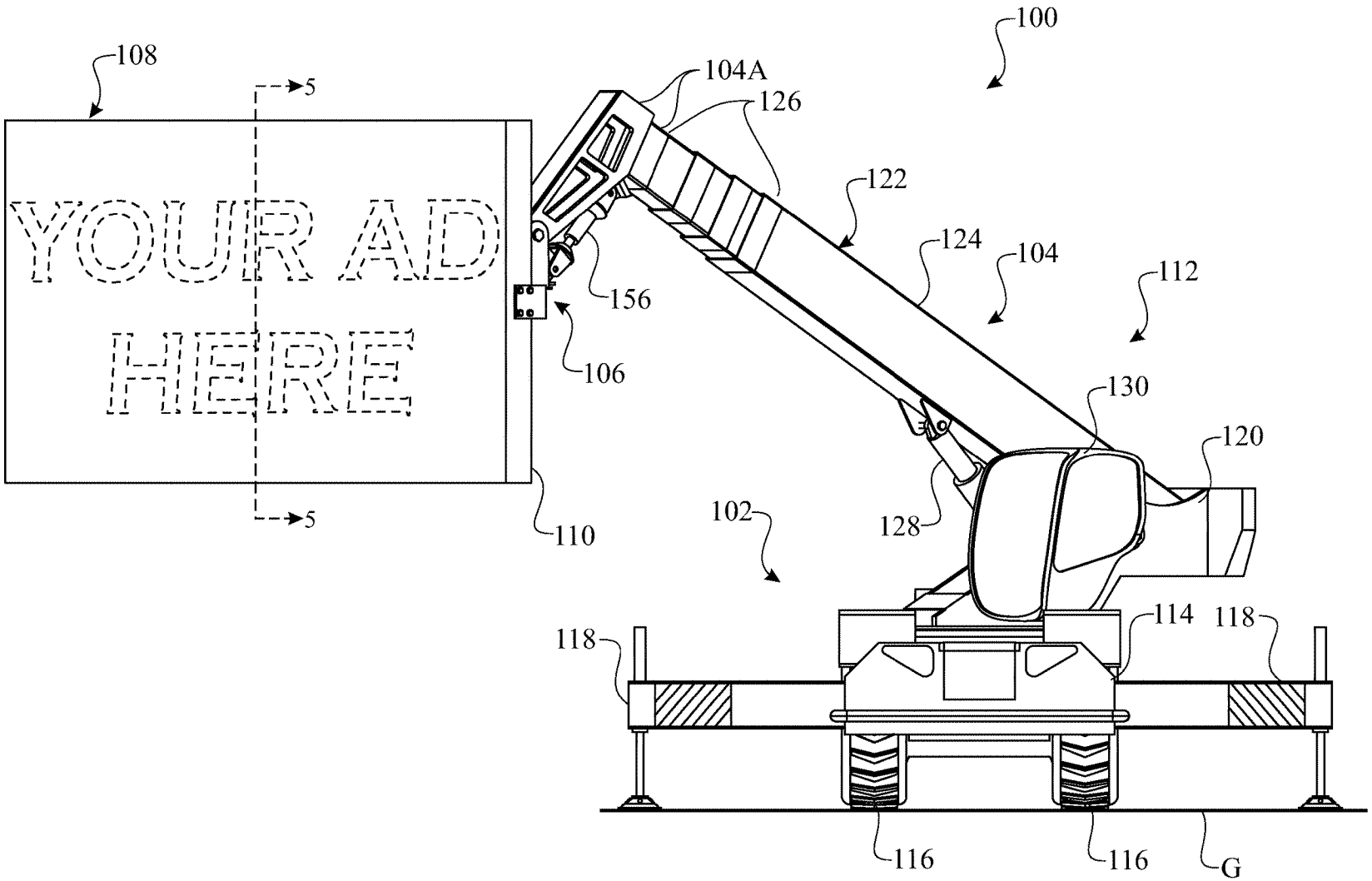
FIG. 1 presents a front elevation view of an exemplary embodiment of an aerial advertising display apparatus in accordance with the present invention having a ground-supported base and a lift mechanism mounted thereon and being capable of being actuated to change the elevation of an advertising display supported above the ground by the lift mechanism.
Figure 2:
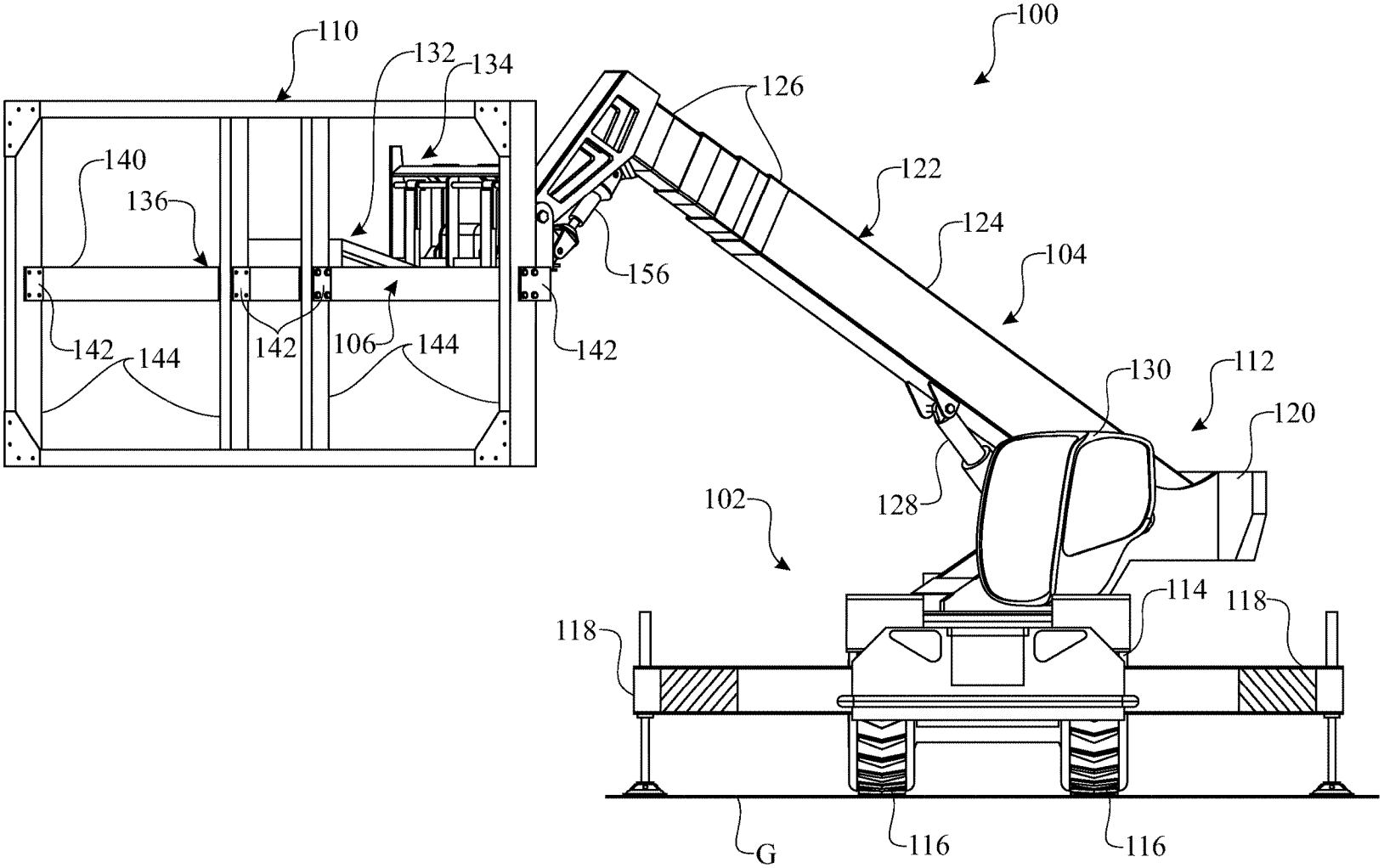
FIG. 2 presents a top front elevation view of the aerial advertising display apparatus originally introduced in FIG. 1, with a poster of the advertising display removed from the advertising display mounting frame to expose an attachment mechanism of the apparatus located at the upper end portion of the lift mechanism.
Figure 3:
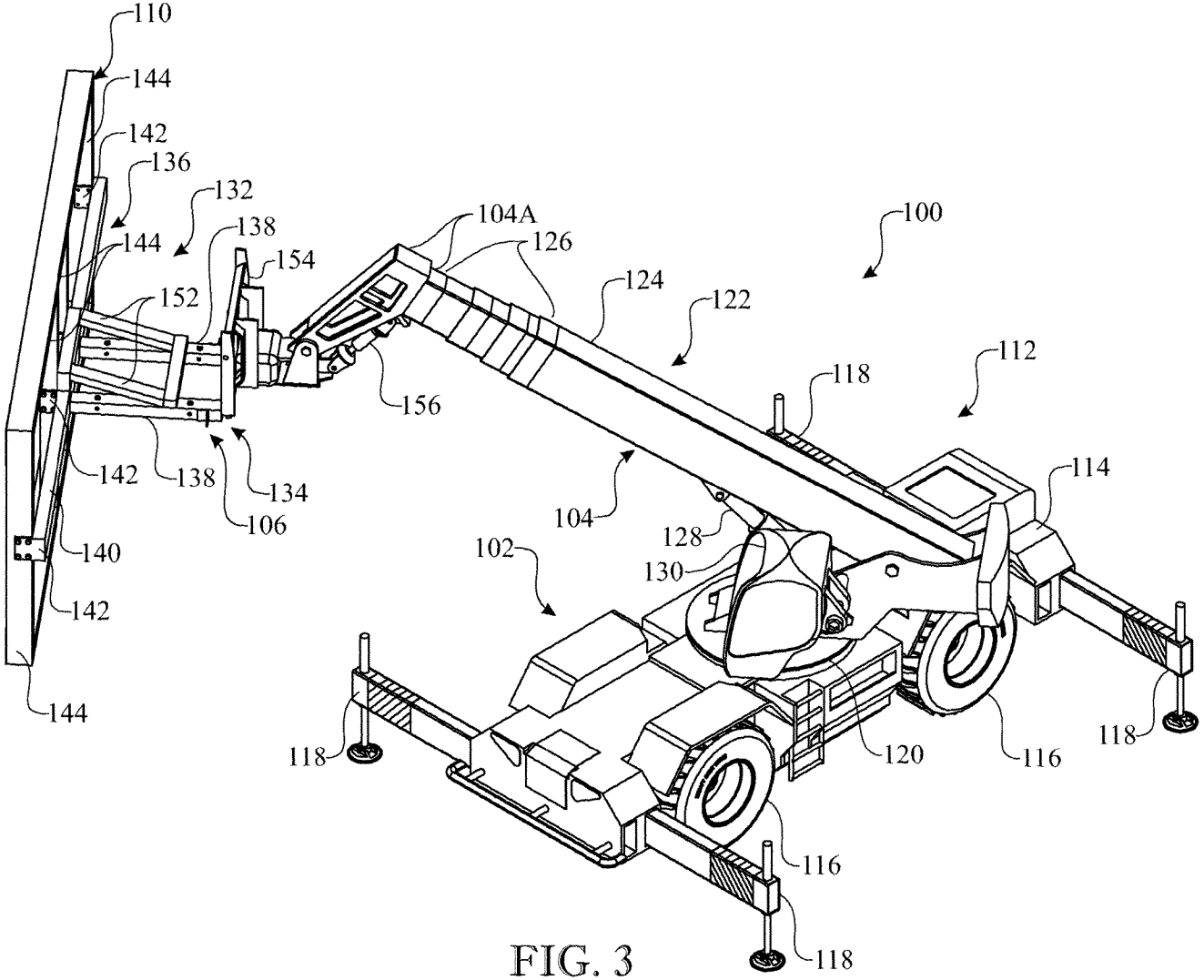
FIG. 3 presents a top isometric view of the aerial advertising display apparatus previously presented in FIG. 2, illustrating forward and rearward components of the attachment mechanism coupled with one another so as to attach the advertising display mounting frame to the upper end portion of the lift mechanism of the apparatus.
Figure 4:
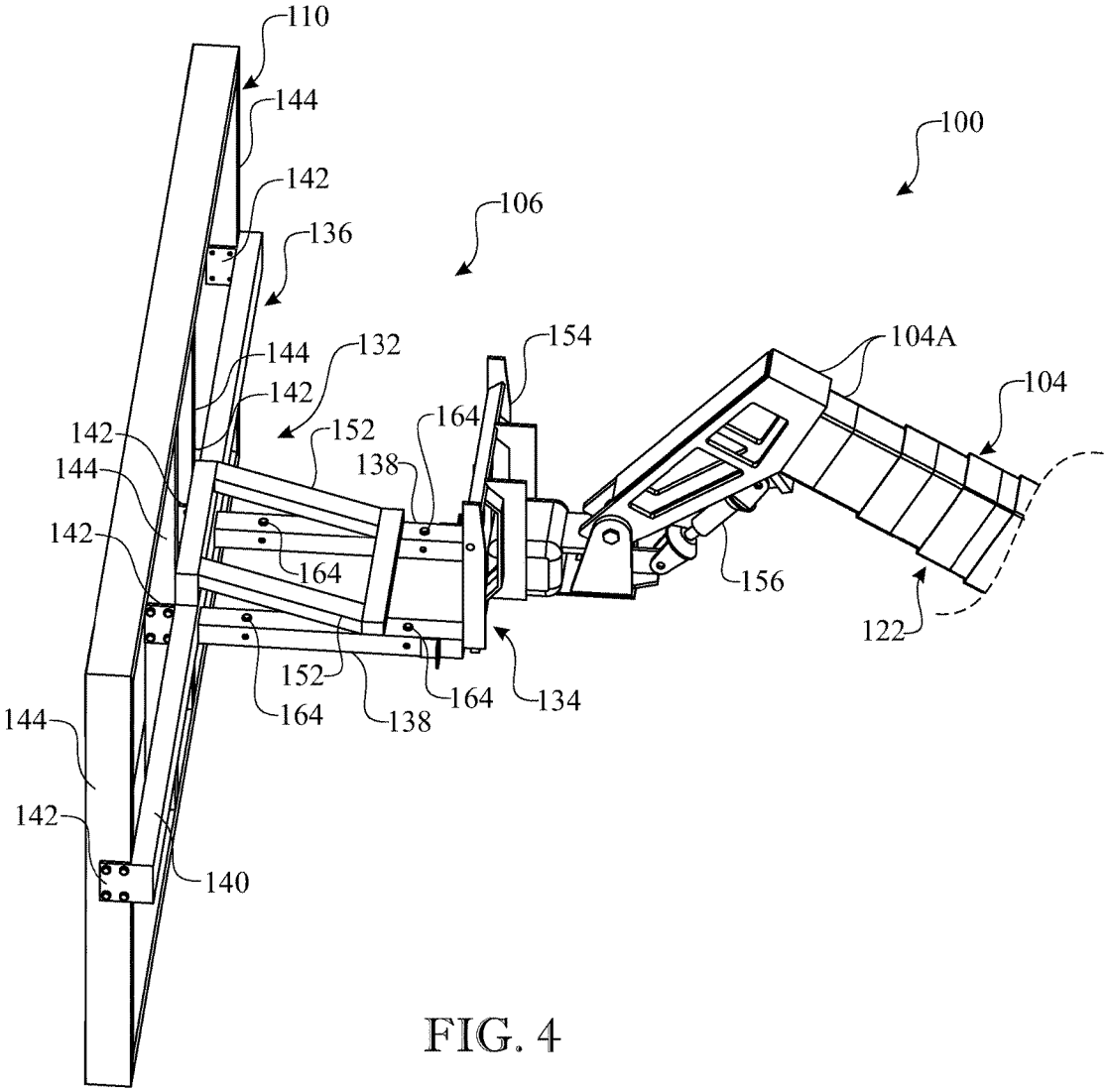
FIG. 4 presents an enlarged top isometric view of a fragmentary portion of the aerial advertising display apparatus as previously presented in FIG. 3, illustrating the upper end portion of the lift mechanism with forward and rearward components of the attachment mechanism inter-fitted together so as to attach the advertising display mounting frame to the lift mechanism.
Figure 5:
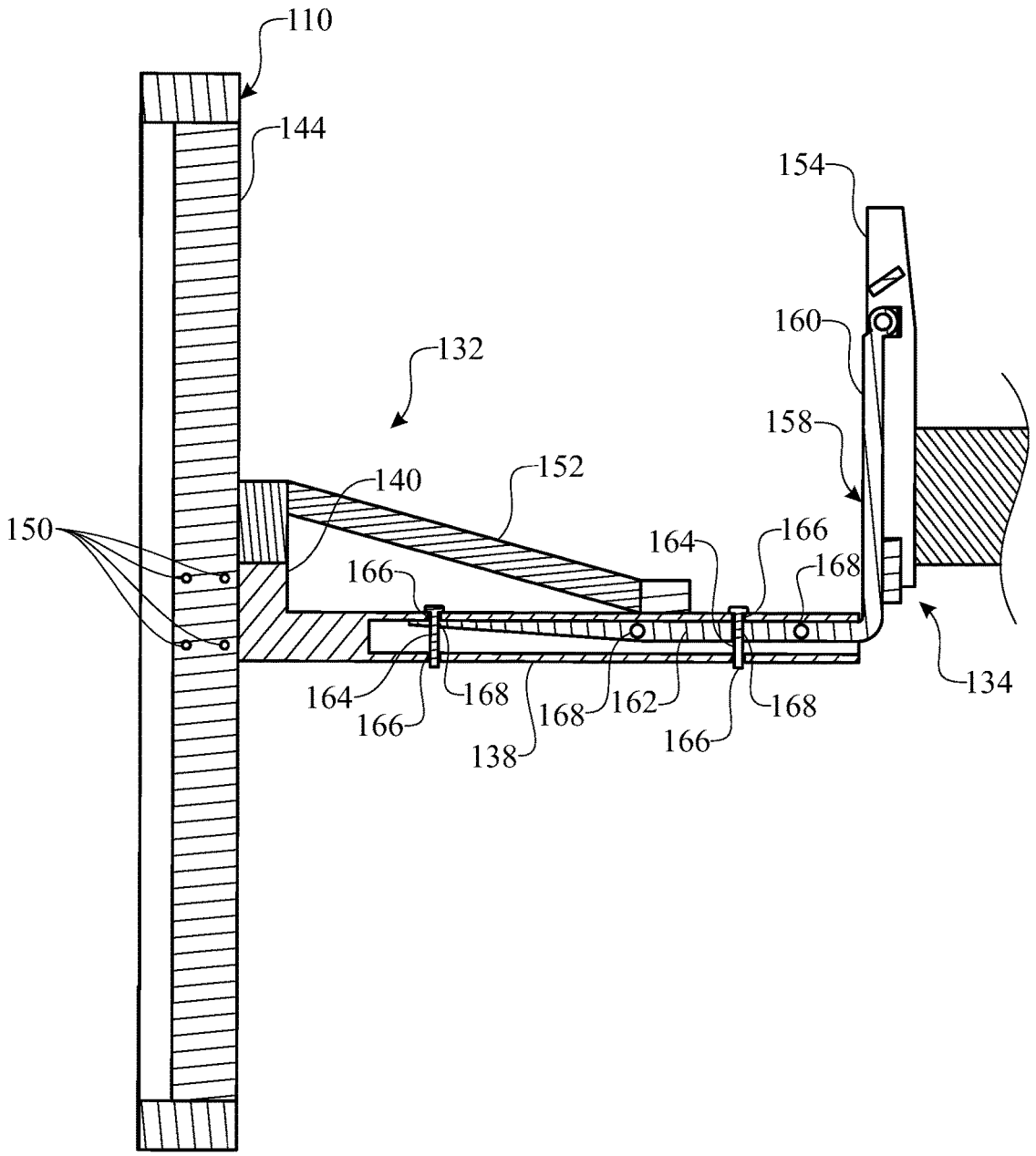
FIG. 5 presents a cross-sectional view of the advertising display mounting frame and the attachment mechanism of the aerial advertising display apparatus (taken vertically along cut line 5-5 of FIG. 1) through a right side portion of the advertising display mounting frame and the attachment apparatus.
Figure 6:
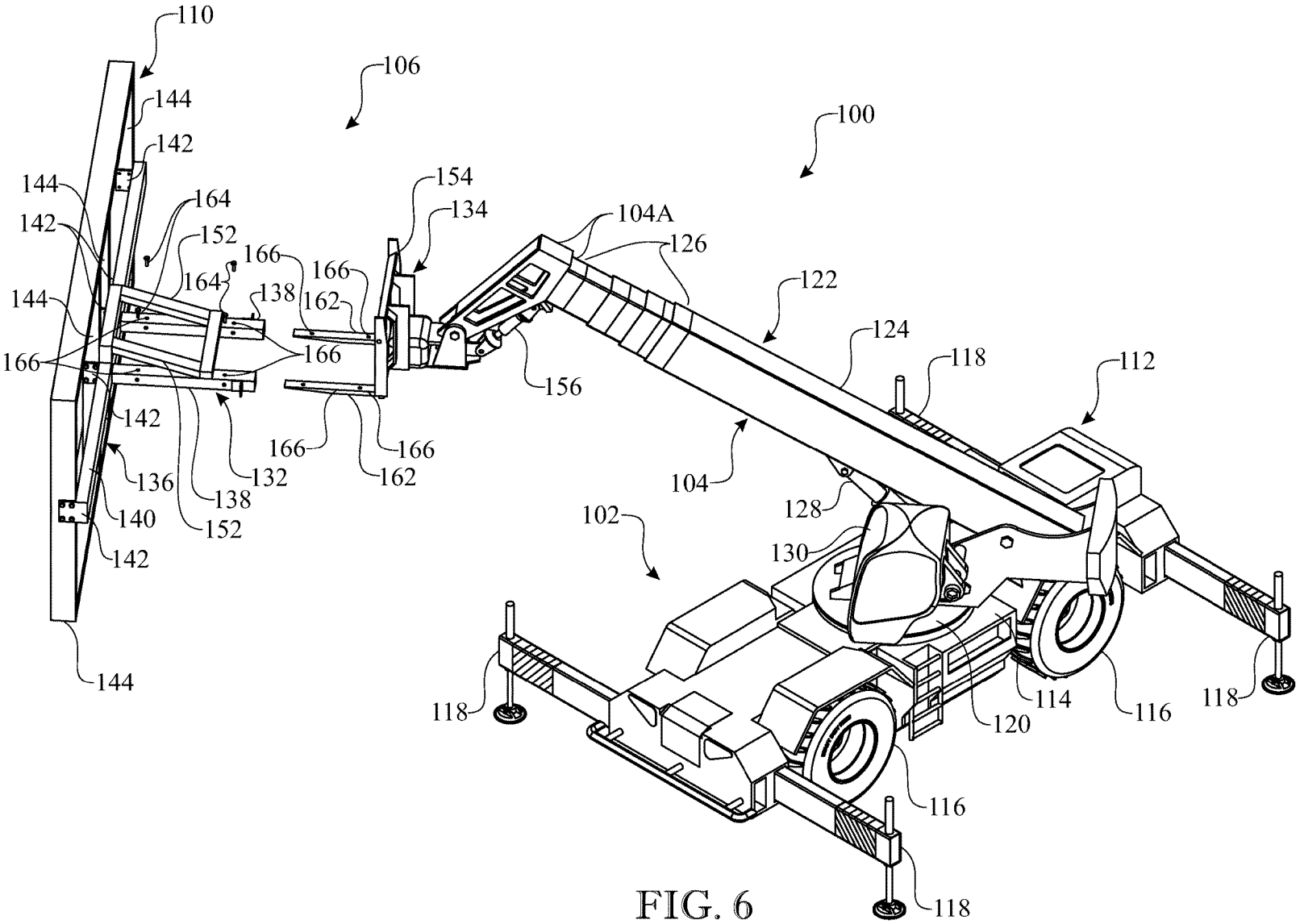
FIG. 6 presents a top isometric view of the aerial advertising display apparatus similar to that as previously presented in FIG. 3, but now illustrating the forward and rearward components of the attachment apparatus detached from one another so as to decouple the advertising display mounting frame from the upper end portion of the lift mechanism of the apparatus.
Figure 7:
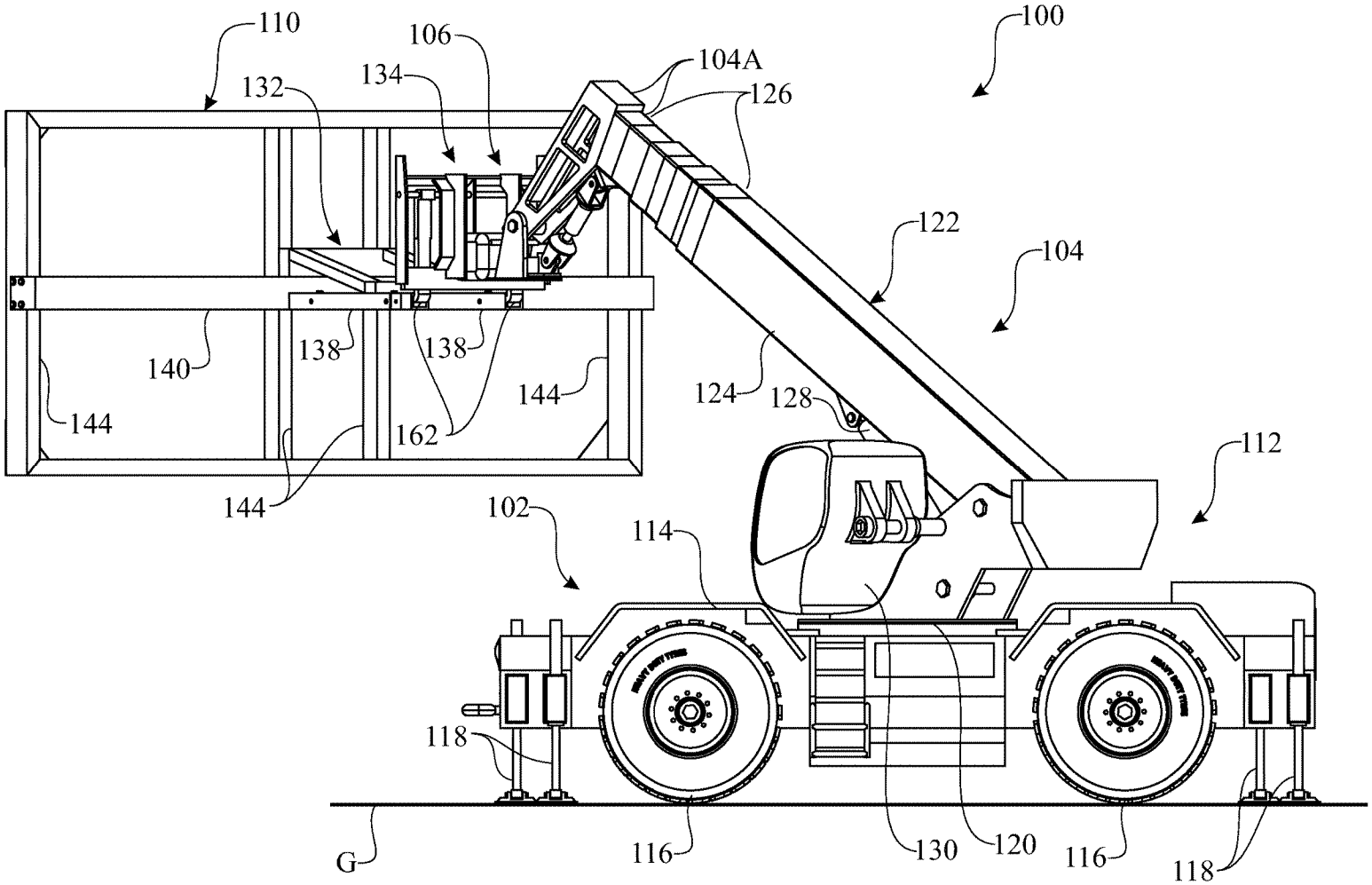
FIG. 7 presents a side elevation view of the aerial advertising display apparatus as seen from the right side of the apparatus as previously presented in FIG. 2.
Figure 8:
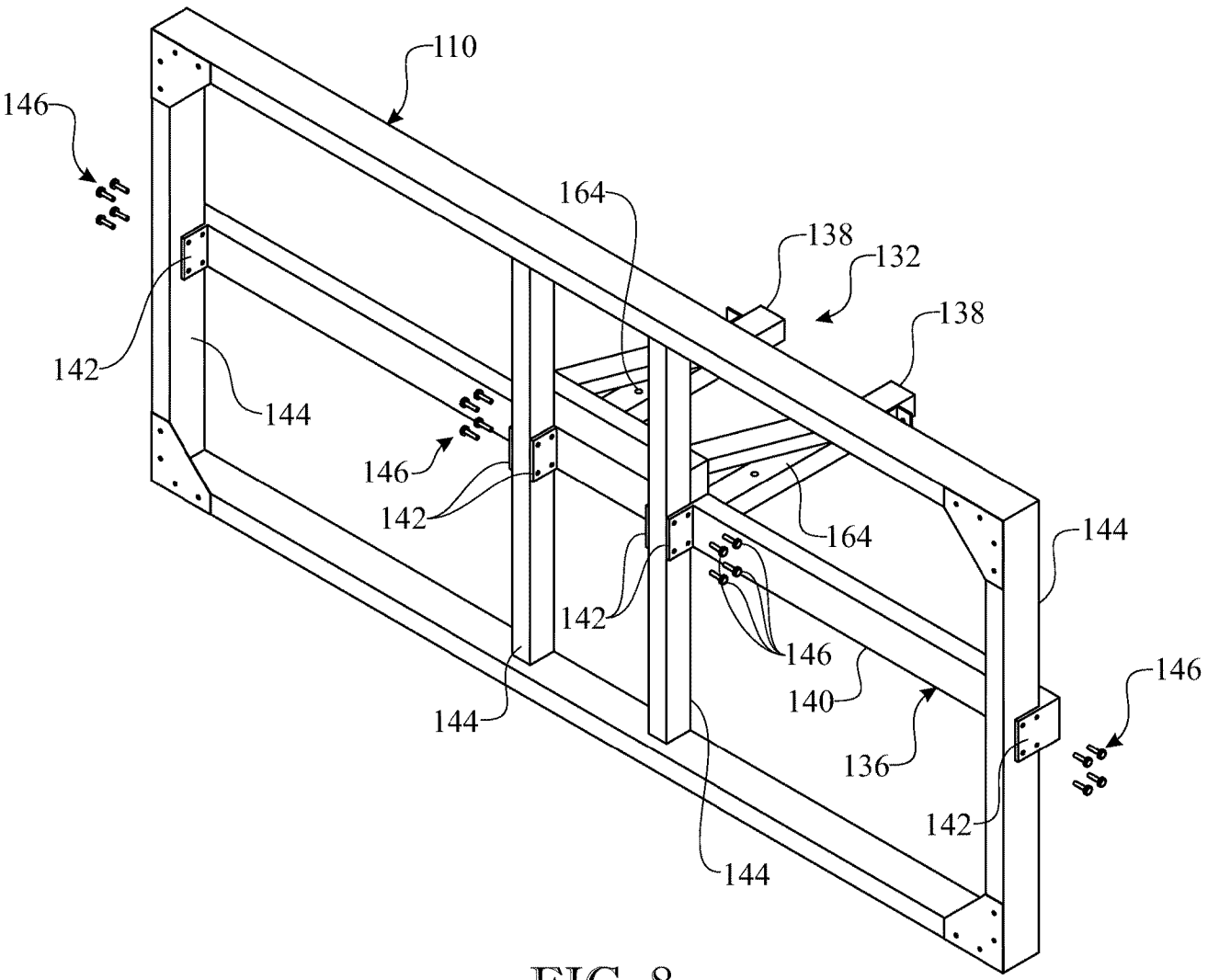
FIG. 8 presents a top front isometric view of the forward component of the attachment mechanism attached to the advertising display mounting frame of the advertising display.
Figure 9:
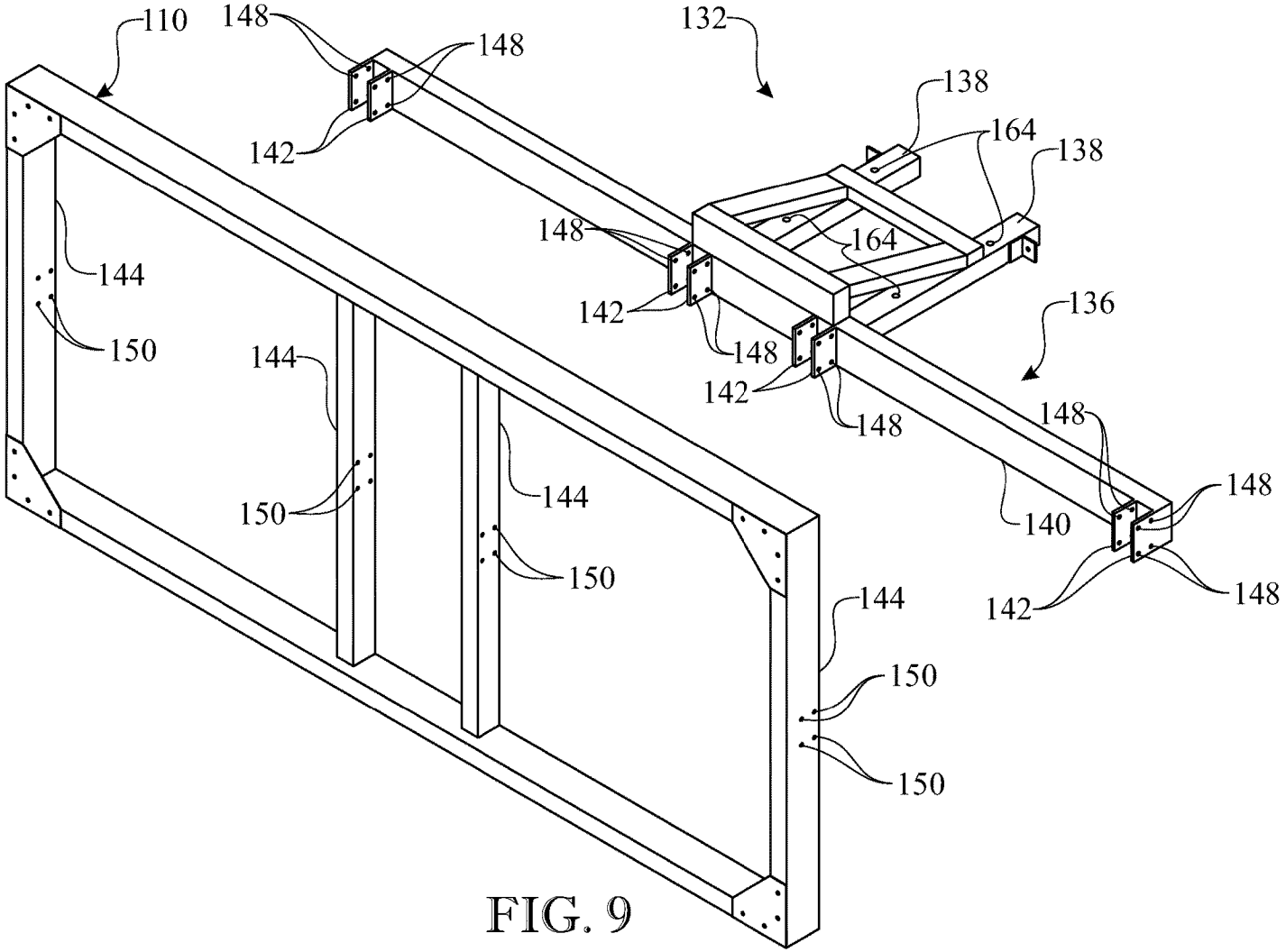
FIG. 9 presents a top front isometric view of the forward component of the attachment mechanism detached from the advertising display mounting frame of the advertising display.
Figure 10:
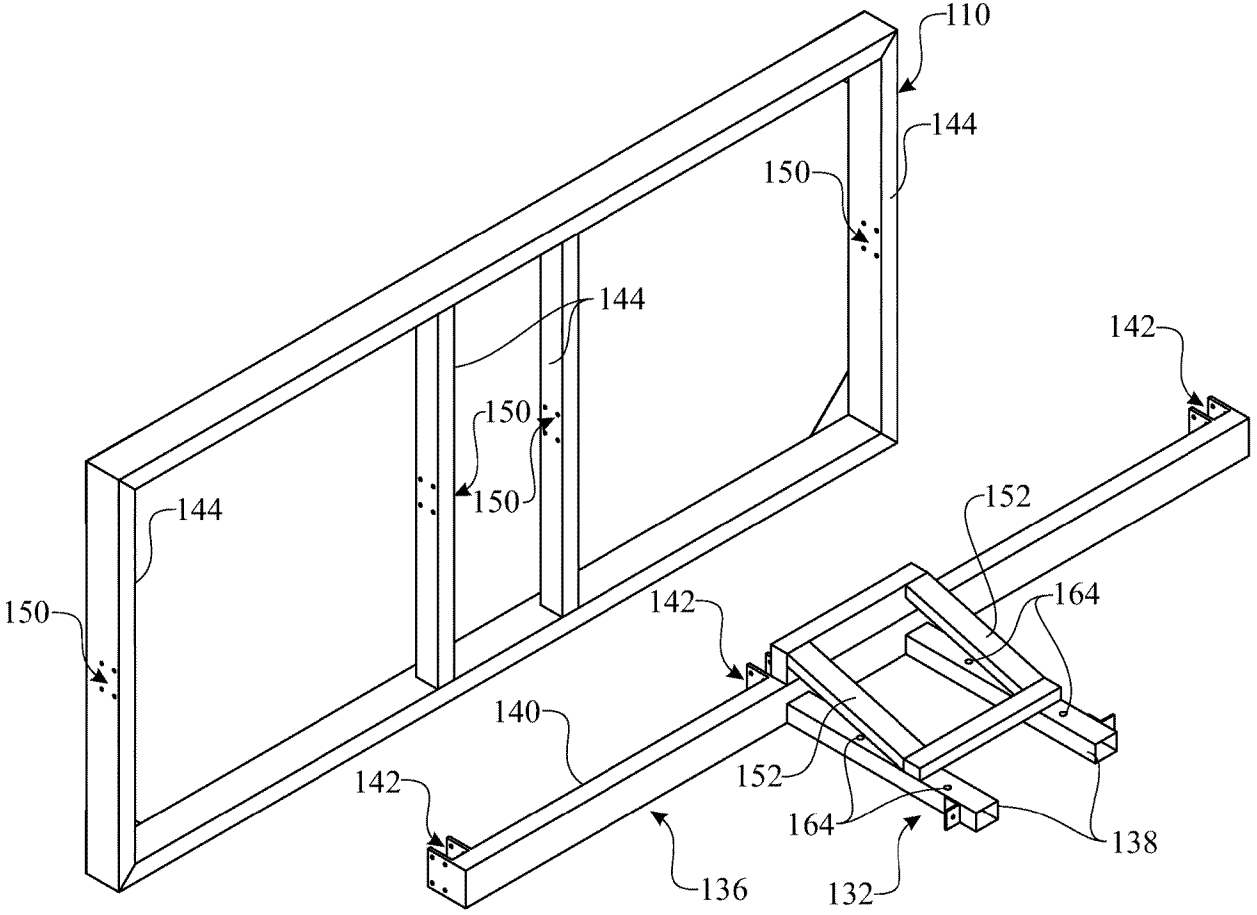
FIG. 10 presents a top rear isometric view of the forward component of the attachment mechanism, shown detached from the advertising display mounting frame of the advertising display.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. The implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-3, 6 and 7, there is illustrated an exemplary embodiment of an aerial advertising display apparatus, generally designated 100, in accordance with the present invention. The apparatus 100 basically includes a support base 102 placed on a support surface G, a lift mechanism 104 mounted on the support base 102, and an attachment mechanism 106 supported by an upper end portion 104A of the lift mechanism 104. The lift mechanism 104 of the apparatus 100 is actuatable, or capable of being actuated, to change the elevation above the support surface G, such as the ground, of the upper end portion 104A of the lift mechanism 104 and thus the elevation of the attachment mechanism 106 and an advertising display 108 supported by the attachment mechanism 106. The advertising display 108 includes an advertising display mounting frame 110 that may carry, by way of example but not limitation, a conventional two-dimensional billboard made of canvas or other panel material, preferably 12 ft.×24 fit. in size, or a more customized three-dimensional object, such as artistic depictions of brands and logos. The advertising display mounting frame 110 can be made of aluminum, steel or any other suitable materials.

The support base 102 and lift mechanism 104 of the apparatus 100, by way of example but not limitation, may be basic components incorporated by an aerial lift vehicle 112 (e.g., a telescopic handler as illustrated in FIGS. 1-4 and 6-7) that may be mobile and either self-propelled or towed by a motor-driven vehicle. The support base 102 may include a chassis 114 of the vehicle 112 supported on wheels 116 and having a plurality of outrigger stabilizers 118 extendable from the chassis 114 to prevent tip-over of the vehicle 112 during its use. The support base 102 also may include a counterweighted turntable 120 mounted for rotation on the chassis 114 about a vertical axis. The lift mechanism 104 may be a telescopic boom 122. The telescopic boom 122 typically includes an outer boom section 124 pivotally mounted at one end to the turntable 120, and a plurality of inner boom sections 126 being telescopically slidably received within one another and within the outer boom section 124 and terminating in the upper end portion 104A of the lift mechanism 104. The upper end portion 104A of the lift mechanism 104 is moved between different elevations above the ground G by extending and retracting the inner boom sections 126, relative to one another and to the outer boom section 124, using one or more hydraulic cylinders (not shown) and/or by rotatably or pivotally moving the outer boom section 124 in clockwise or counterclockwise directions upwardly and downwardly relative to the turntable 120 using a hydraulic cylinder 128. Suitable controls (not shown) located in a cab 130 supported on the turntable 120 may be manipulated by an operator in the cab 120 to operate such functions as lift mechanism angle and extension, and rotation of the lift mechanism 104 about a vertical axis, along with engine, steering and braking controls.

Referring now to FIGS. 1-10, the attachment mechanism 106 of the apparatus 100 basically includes a forward component 132 and a rearward component 134. The forward component 132 is attached to and disposed rearwardly of the advertising display mounting frame 110. The rearward component 134 is attached to the upper end portion 104A of the lift mechanism 104. The forward and rearward components 132, 134 of the attachment mechanism 106 are configured to interfit with one another, so as to attach with, and detach from, one another to correspondingly couple and decouple the advertising display mounting frame 110 to and from the upper end portion 104A of the lift mechanism 104.

More particularly, as best seen in FIGS. 4-6 and 8-10, the forward component 132 of the attachment mechanism 106 includes a mounting structure 136 and a pair of elongated tubular members 138. The mounting structure 136 is attached at a rear side to forward ends of the tubular members 138 and is configured at a front side to detachably attach to the advertising display mounting frame 110. The mounting structure 136 includes an elongated beam 140 extending in a transverse relationship to the tubular members 138 and a plurality of connectors in the form of a plurality of plates 142 attached on, and projecting forwardly from, the front side of the beam 140. The plates 142 are attached respectively to sides of laterally spaced apart upright members 144 of the advertising display mounting frame 110. For example, fasteners 146 are inserted through apertures 148 in the plates 142 and tightened into holes 150 in the upright members 144 aligned with the apertures 148.

The elongated tubular members 138 of the forward component 132 project rearwardly from the elongated beam 140 of the mounting structure 136. The tubular members 138 are laterally spaced apart and extend fore-and-aft and parallel to one another. The forward component 132 also includes braces 152 extending between and attached to the elongated beam 140 and the tubular members 138 so as to reinforce the structural integrity of the forward component 132 of the attachment mechanism 106.

Also, as best seen in FIGS. 3-6, the rearward component 134 of the attachment mechanism 106 includes a mounting structure 154 pivotally mounted to the upper end portion 104A of the lift mechanism 104 and an actuator 156, such as a hydraulic cylinder, pivotally mounted to the upper end portion 104A of the lift mechanism 104 and coupled to the mounting structure 154. The actuator 156 is selectively operable to pivotally move the mounting structure 154 upwardly and downwardly relative to the lift mechanism 104 in order to place the advertising display mounting frame 110 in a desired elevated orientation. The rearward component 134 also includes a pair of right-angled members 158 having upper portions 160 that maintain the rearward component 134 stationarily mounted to the mounting structure 154. The right-angled members 158 also have lower portions in the form of forwardly-projecting tines 162 extending forwardly from the lower ends of the upper portions 160 and parallel to one another such that the tines 162 are configured to slidably insert into and interfit with the rearwardly-projecting elongated tubular members 138 of the forward component 132 of the attachment mechanism 106.

The attachment mechanism 106 further includes a plurality of fasteners 164 and aligned pairs of apertures 166, 168 formed respectively in the tubular members 138 of the forward component 132 and in the tines 162 of the rearward component 134. The fasteners 164 are insertable through selected ones of the pairs of apertures 166 through the tubular members 138 and selected ones of the pairs of apertures 168 through the tines 162 of the rearward component 134 when the selected pairs of apertures 166, 168 are aligned with each other as a result of the tubular members 138 and tines 162 being interfitted with one another.

Figure 11:
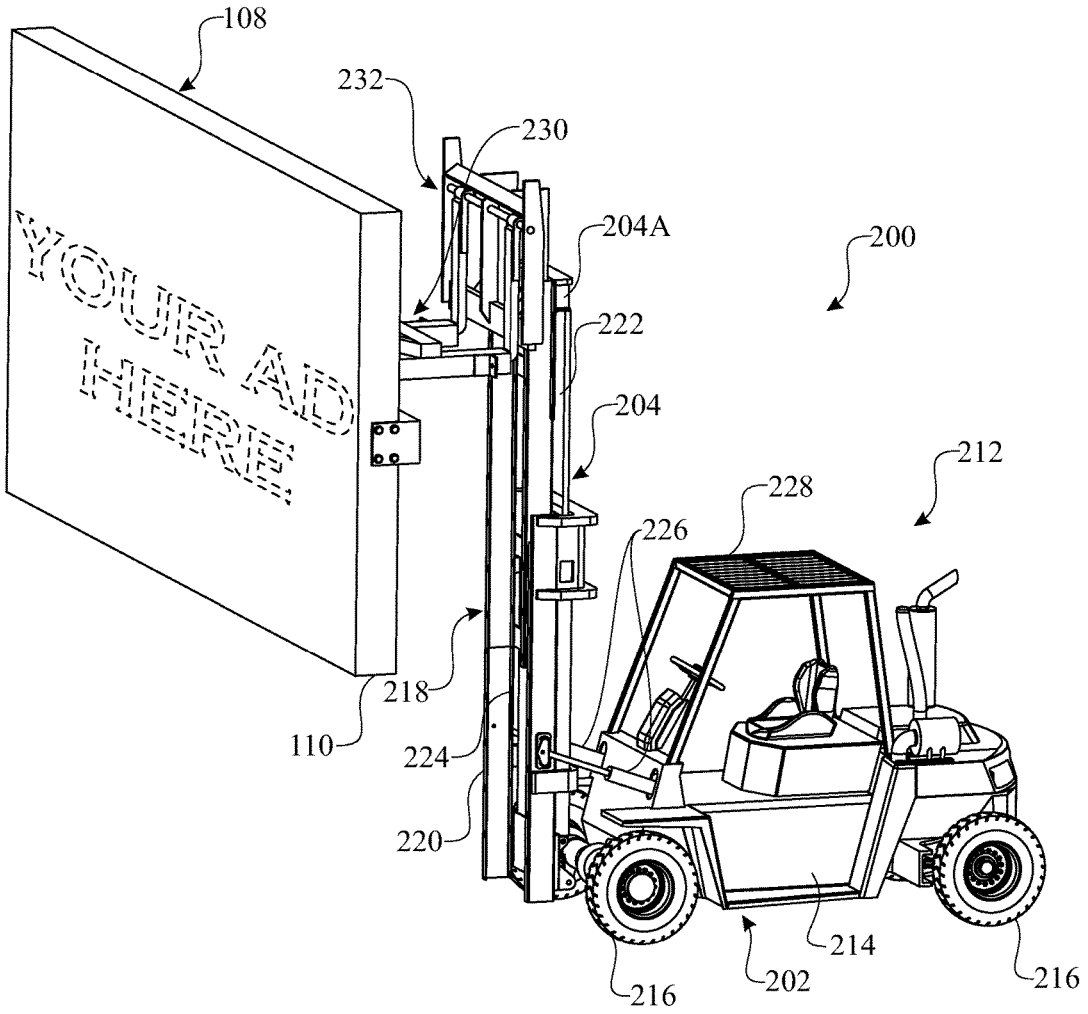
FIG. 11 presents a side isometric view an exemplary alternative embodiment of an aerial advertising display apparatus in accordance with the present invention, having a ground-supported base and a lift mechanism mounted thereon and capable of being actuated to change the elevation of an advertising display supported by the lift mechanism.

Referring now to FIG. 11, there is illustrated an exemplary alternative embodiment of an aerial advertising display apparatus, generally designated 200, in accordance with the present invention. The apparatus 200 basically includes a support base 202 placed on a support surface G, a lift mechanism 204 mounted on the support base 202, and an attachment mechanism 206 supported by an upper end portion 204A of the lift mechanism 204. The lift mechanism 204 of the apparatus 200 is actuatable to change the elevation above the support surface G, such as the ground, of the upper end portion 204A of the lift mechanism 204 and thus the elevation of the attachment mechanism 206 and an advertising display 208 supported by the attachment mechanism 206. The advertising display 208 includes an advertising display mounting frame 210 that may support, by way of example but not limitation, a conventional two-dimensional billboard, or a more customized three-dimensional object, such as artistic representations of brands and logos.

The support base 202 and lift mechanism 204 of the apparatus 200, by way of example but not limitation, may be basic components incorporated by a mobile lift truck or vehicle 212. The support base 202 may include a chassis 214 of the vehicle 212 supported on wheels 216. The lift mechanism 204 may be a telescopic upright channel structure 218 mounted to the chassis 214. The telescopic channel structure 218 typically include an outer elongated channel section 220 pivotally mounted at one end to the chassis 214, and at least one inner elongated channel section 222 being telescopically slidably received within the outer channel section 220 and terminating in the upper end portion 204A of the lift mechanism 204. The upper end portion 204A of the lift mechanism 204 is moved between different elevations above the ground G by extending and retracting the inner channel section 222 relative to the outer channel section 220, using one or more hydraulic cylinders 224 and/or by rotatably or pivotally moving the outer channel section 220 upwardly and downwardly relative to the chassis 214 using hydraulic cylinders 226. Suitable controls (not shown) located in a cab 228 may be manipulated by an operator in the cab 228 to operate such functions as lift mechanism angle and extension, and rotation of the lift mechanism 204 about a vertical axis, along with engine, steering and braking controls.

The attachment mechanism 206 supported by the upper end portion 204A of the lift mechanism 204 includes a forward component 230 attached to an advertising display mounting frame 210, and a rearward component 232 attached to the upper end portion 204A of the lift mechanism 204. The forward and rearward components 230, 232 of the attachment mechanism 206 of the apparatus 200 are the same as the forward and rearward components 132, 134 of the attachment mechanism 106 of the apparatus 100. Thus, a detailed description of the forward and rearward components 230, 232 of apparatus 200 need not be repeated herein; instead attention is directed to the detailed description of the forward and rearward components 132, 134 of the apparatus 100 set forth earlier with reference to FIGS. 4-6 and 8-10.

Figure 12:
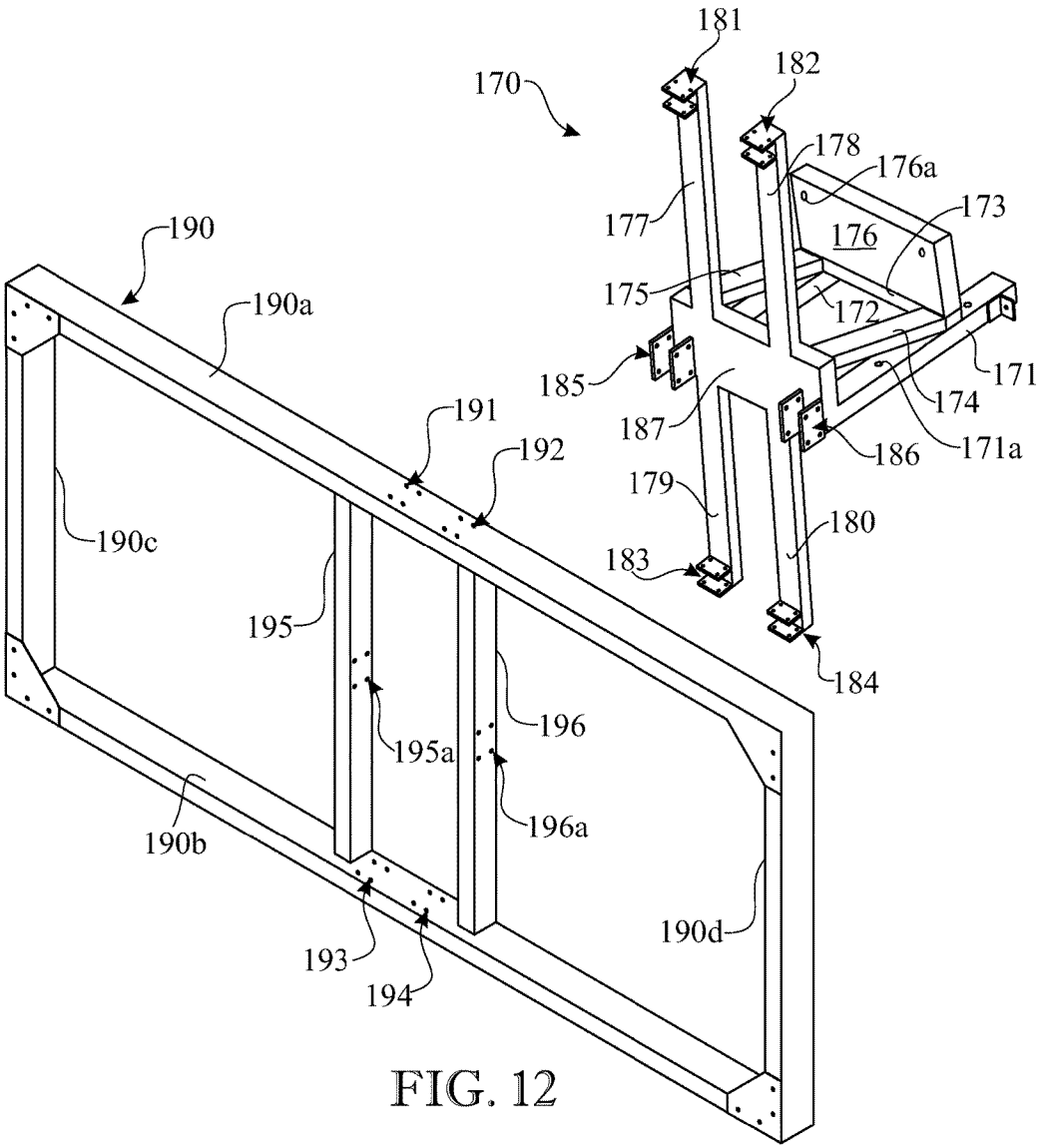
FIG. 12 presents a top front isometric exploded view of a forward component the attachment mechanism, shown detached from the advertising display mounting frame of the advertising display, in accordance with an alternate implementation.

Referring now to FIGS. 1-18, and particularly to FIG. 12, in an exemplary alternate implementation of the invention, the forward component 132 (FIG. 1) of attachment mechanism 106 is replaced by forward component 170 (FIG. 12), which is capable of accommodating a wider advertising display mounting frame 110. The forward component, shown generally as reference numeral 170, includes a pair of spaced-apart parallel left and right tubular members, 171 and 172, respectively, extending rearwardly from a lower end of main body portion 187, each including respective apertures, 171*a* and 172*a*, extending vertically therethrough. A pair of corresponding spaced-apart, left and right angled tubular members, 174 and 175, is provided extending in a rearward and downward angle from an upper end of main body portion 187 and terminating at a cross brace 173 supported upon and spanning right and left tubular members 171 and 172, respectively. A vertically-oriented plate 176 is provided having a lower end interfacing with an upper surface of cross brace 173. Spaced-apart, horizontally-disposed apertures 176*a* are provided extending completely through forward plate 176 for a purpose explained further hereinbelow. Spaced-apart right and left vertical brace portions, 177 and 178, respectively, extend upwardly from an upper edge of main body portion 187, each having corresponding pairs of plates, 181 and 182, at upper ends thereof. Spaced-apart right and left vertical brace portions, 179 and 180, respectively, extend downwardly from a lower edge of main body portion 187, each having a corresponding pair of plates, 183 and 184, at lower ends thereof. Each set of plates 181, 182, 183 and 184, have a plurality of aligned apertures extending therethrough. Furthermore, right and left pairs of plates, 185 and 186, respectively, extend forwardly from a front surface of main body portion 187, each also having a plurality of aligned apertures extending therethrough.

An aerial advertisement display mounting frame, shown generally as reference numeral 190, has a rectilinear geometry made up of contiguous frame segments 190*a*-190*d*. A pair of vertically-disposed, spaced-apart, right and left interior braces, 195 and 196, respectively, is provided extending between interior-facing surfaces of upper frame segment 190*a* and lower frame segment 190*b*, each having a respective plurality of brace apertures, 195*a* and 195*b*, extending therethrough. Furthermore, two sets of apertures, 191 and 192, are provided extending through upper frame segment 190*a*, and two corresponding aligned sets of apertures, 193 and 194, are provided extending lower frame segment 190*b*.

During assembly of forward component 170 to display mounting frame 190, plates 181 and 182 receive upper frame segment 190*a*, such that the apertures in plates 181 and 182 align with corresponding apertures 191 and 192. Likewise, plates 183 and 184 receive lower frame segment 190*b*, such that the apertures in plates 183 and 184 align with corresponding apertures 193 and 194. Furthermore, during assembly of forward component 170 to display mounting frame 190, plates 185 and 186 receive upper frame braces 195 and 196 such that the apertures in plates 185 and 186 align with corresponding apertures 195*a* and 196*a*. Subsequently, conventional fastener hardware, such as bolts and nuts, are inserted through the aligned apertures to securely fasten forward component 170 to display mounting frame 190.

Figure 13:
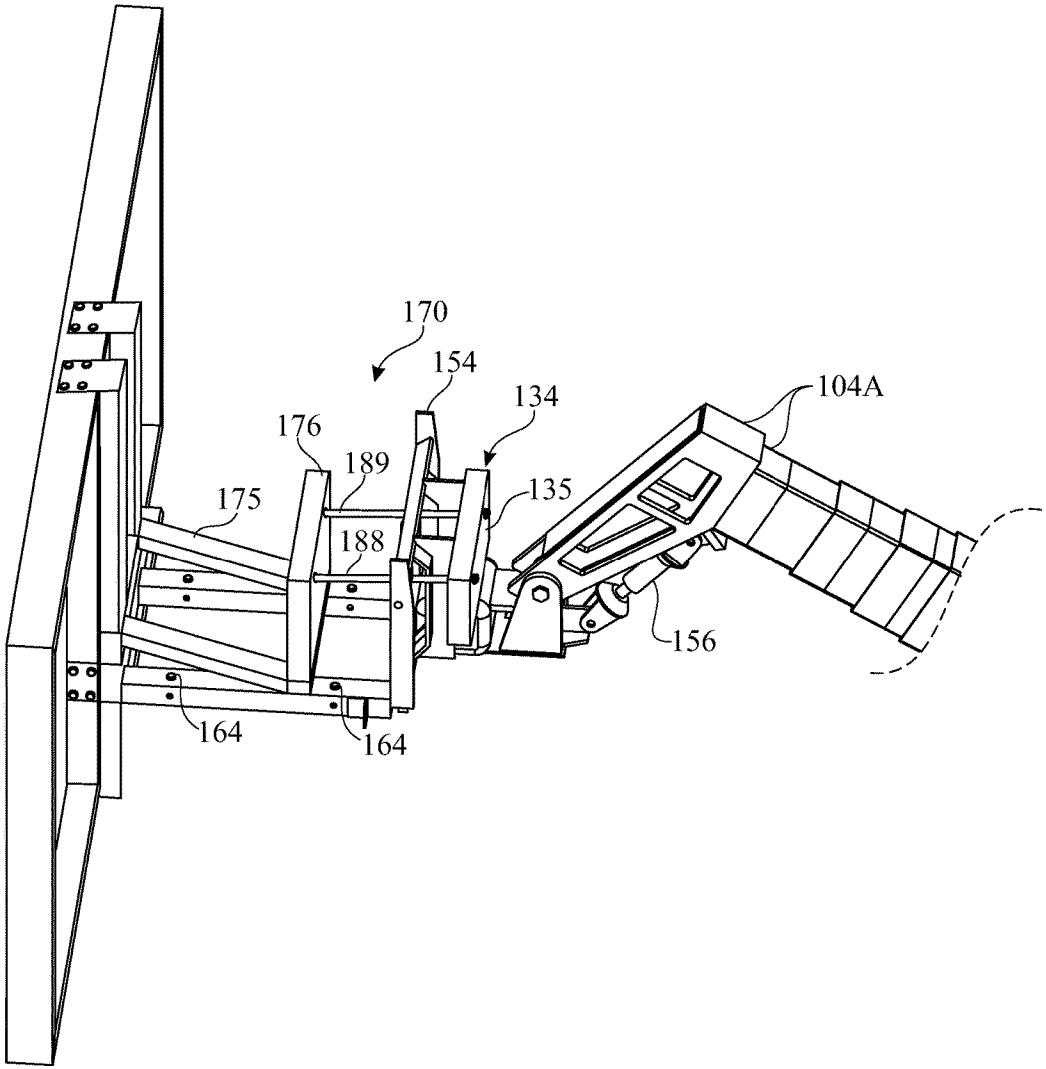
FIG. 13 presents a top side isometric view of the alternative attachment mechanism forward component depicted in FIG. 12, shown assembled to the advertising mounting structure and to the rear component of the attachment mechanism.

Referring now primarily to FIG. 13, the forward component 170 is shown fully assembled and fixedly attached to the display frame 190. As can be seen, in this exemplary implementation, the rearward component 134 of attachment mechanism 106 has been modified to incorporate a rearward plate 135 fixedly secured, or otherwise attached, to the rearward component 134 of the attachment mechanism 106 of the aerial lift vehicle 112 to provide increased stability of the mounting frame 190. More specifically, left and right rigid fastener rods, 188 and 189, respectively, are provided extending through apertures in rearward plate 135, which apertures are aligned with corresponding aperture 176*a* in forward stabilizing plate 176, and fixedly attached using any known conventional hardware. For example, the rods, 188, 189 may comprise large rigid bolts fastened in place using nuts.

Figure 14:
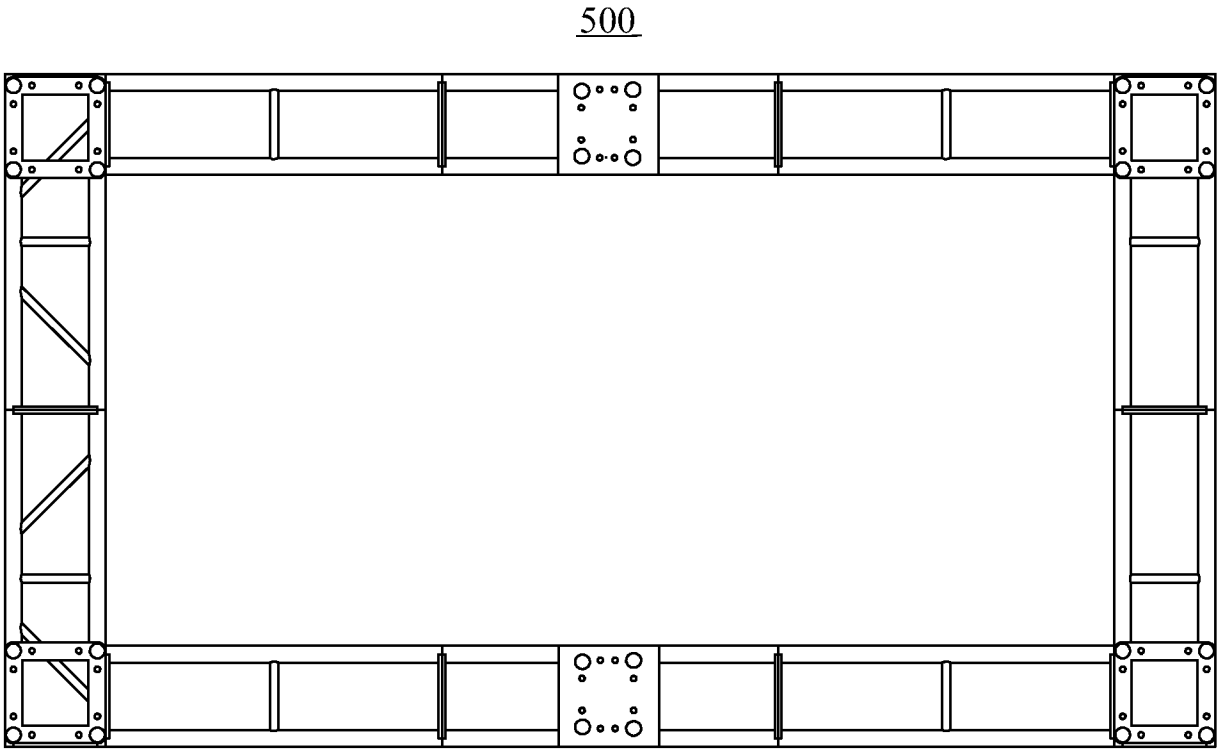
FIG. 14 is a front elevation view of an exemplary advertising display mounting frame having an aluminum truss construction enabling dimensional variation to accommodate a wide range of advertising canvas areas, in accordance with an alternate implementation.

Referring now briefly to FIG. 14, a front elevation view shows an exemplary advertising display mounting frame having an aluminum truss construction enables dimensional variation to accommodate a wide range of advertising canvas areas, in accordance with an alternate implementation.

Figure 15:
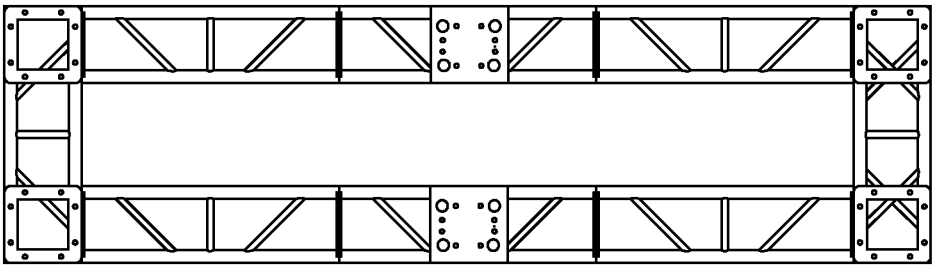
FIG. 15 is a top view of an exemplary aerial advertising display mounting frame module having an aluminum truss construction for enabling/facilitating on-site, size-specific framework adjustment, facilitating adjustment for variable advertisement canvas surface area, in accordance with an alternate implementation.

Referring now briefly to FIG. 15, a top view shows an exemplary aerial advertising display mounting frame module having an aluminum truss construction for enabling/facilitating on-site, size-specific framework adjustment, facilitating adjustment for variable advertisement canvas surface area, in accordance with an alternate implementation.

Figure 16:
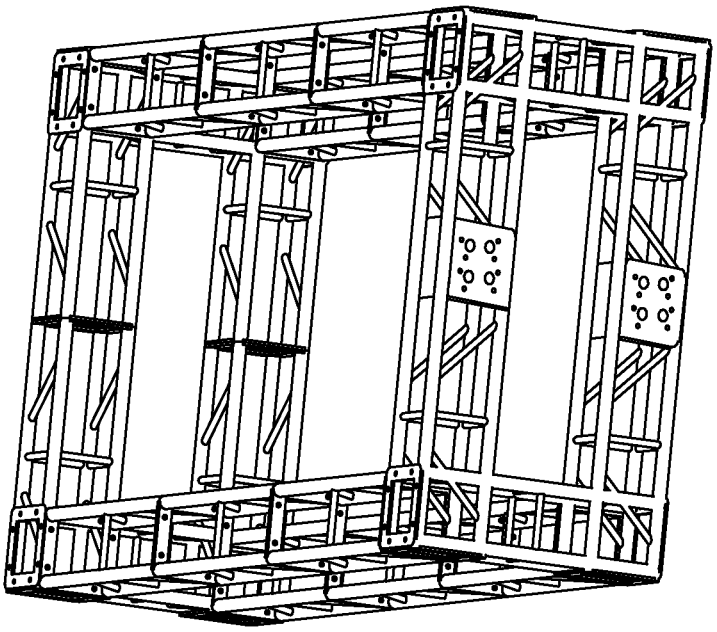
FIG. 16 is an isometric view of an exemplary aerial advertising display mounting frame module having a multiple module aluminum truss construction for facilitating multi-sided aerial advertising.

Referring now briefly to FIG. 16, an isometric view is shown of an exemplary aerial advertising display mounting frame module having a multiple module aluminum truss construction for facilitating multi-sided aerial advertising.

Figure 17:
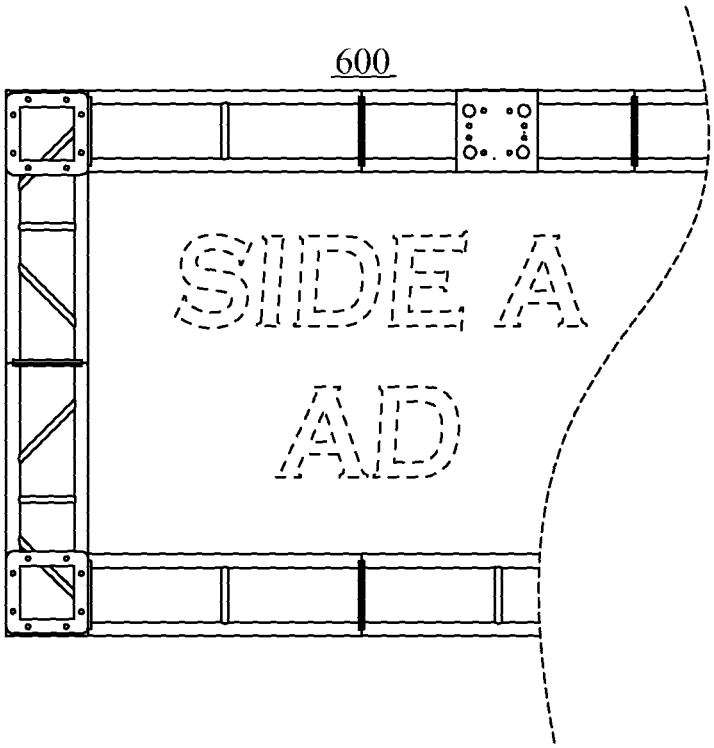
FIG. 17 is a partial front view showing a first advertisement on a front side surface using the exemplary mounting frame of FIG. 15.
Figure 18:
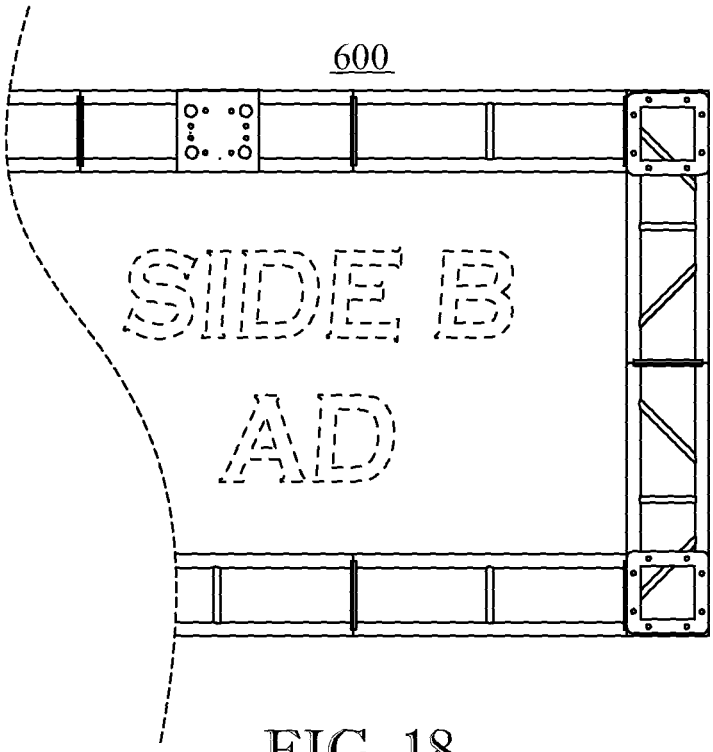
FIG. 18 is a partial rear view showing a first advertisement on a front side surface using the exemplary mounting frame of FIG. 15.

Referring now briefly to FIGS. 17 and 18, front and rear views are shown of an exemplary use of the display mounting frame of FIG. 15 for simultaneously displaying multiple advertisements.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. An aerial advertising display apparatus, comprising:

a support base for placing on a support surface;

a lift mechanism mounted on said base and being actuatable to change the elevation of an upper end portion of said lift mechanism above the support surface; and an attachment mechanism supported by said upper end portion of said lift mechanism, said attachment mechanism comprising a forward component attached to and disposed rearwardly of an advertising display mounting frame, said forward component of said attachment mechanism comprising a pair of rearwardly-projecting elongated tubular members being laterally spaced apart and extending fore-and-aft and parallel with one another, said elongated tubular members having forward ends, and a first mounting structure having a front side and a rear side, said first mounting structure being attached at said rear side to said forward ends of said tubular members, said first mounting structure being configured at said front side to detachably attach to the advertising display mounting frame, and a rearward component attached to said upper end portion of said lift mechanism, said forward and rearward components being configured to interfit with one another so as to attach with and detach from one another to correspondingly couple and decouple the advertising display mounting frame to and from said upper end portion of said lift mechanism.

2. The apparatus of claim 1 further comprising a mobile aerial lift vehicle including said support base and said lift mechanism mounted thereon.

3. The apparatus of claim 2 wherein said support base includes a mobile chassis and a turntable rotatably mounted on said mobile chassis, said lift mechanism being a telescopic boom pivotally mounted to said turntable.

4. The apparatus of claim 2 wherein said mobile aerial lift vehicle further comprises a telescopic handler.

5. The apparatus of claim 1 wherein said first mounting structure further comprises a main body portion and a pair of spaced-apart right and left vertical brace members extending upwardly and downwardly from said main body portion, said main body portion at said rear side of said first mounting structure being attached to said forward ends of said tubular members.

6. The apparatus of claim 5 wherein said spaced-apart vertical brace members have a plurality of connectors projecting forwardly from said front side of said first mounting structure and being configured to attach to the advertising display mounting frame.

7. The apparatus of claim 6 wherein said plurality of connectors further comprise a plurality of plates attached to a laterally-extending upper frame segment, a laterally-extending lower frame segment, and a pair of vertically-extending spaced apart interior frame segments of said advertising display mounting frame.

8. The apparatus of claim 1 wherein said rearward component of said attachment mechanism comprises a pair of forwardly-projecting tines configured to slidably insert into and interfit with said rearwardly-projecting elongated tubular members of said forward component of said attachment mechanism.

9. The apparatus of claim 8 wherein said attachment mechanism further comprises a plurality of fasteners insertable through a plurality of apertures defined in said tubular members of said forward component and a plurality of apertures defined in said tines of said rearward component, and aligned with said plurality of apertures defined in said tubular members, when said tubular members and tines are interfitted with one another.

10. The apparatus of claim 8 wherein said rearward component of said attachment mechanism further includes:

a second mounting structure pivotally mounted to said upper end portion of said lift mechanism; and an actuator pivotally mounted to said upper end portion of said lift mechanism and coupled to said second mounting structure, said actuator being selectively operable to pivotal move said second mounting structure upwardly and downwardly relative to said lift mechanism.

11. A mobile aerial advertising display apparatus, comprising:

a ground-supported mobile chassis;

a lift mechanism comprising a telescopic boom supported on said mobile chassis and being actuatable to undergo rotational movement in clockwise and counterclockwise directions and horizontal and vertical directions relative to said mobile chassis so as to change the elevation of an upper end portion of said lift mechanism above the ground; and an attachment mechanism supported by said upper end portion of said lift mechanism, said attachment mechanism comprising a forward component attached to and disposed rearwardly of an advertising display mounting frame, said forward component comprising a pair of rearwardly-projecting elongated tubular members being laterally spaced apart and extending fore-and-aft and parallel to one another, a rearward component attached to said upper end portion of said lift mechanism, said rearward component comprising a pair of forwardly-projecting tines configured to slidably insert into said rearwardly-projecting elongated tubular members of said forward component such that said forward and rearward components interfit with one another, and a plurality of fasteners insertable through a plurality of apertures defined in said tubular members of said forward component and a plurality of apertures defined in said tines of said rearward component, and aligned with said plurality of apertures defined in said tubular members, such that when said tubular members and tines are interfitted with one another said forward and rearward components are adapted by said fasteners to attach with and detach from one another to correspondingly couple and decouple the advertising display mounting frame to and from said upper end portion of said lift mechanism.

12. The apparatus of claim 11 wherein said rearward component of said attachment mechanism further includes:

a mounting structure pivotally mounted to said upper end portion of said lift mechanism; and an actuator pivotally mounted to said upper end portion of said lift mechanism and coupled to said mounting structure, said actuator being selectively operable to pivotal move said mounting structure upwardly and downwardly relative to said lift mechanism.

13. A mobile aerial advertising display apparatus, comprising:

a ground-supported mobile chassis;

a lift mechanism comprising a telescopic boom supported on said mobile chassis and being actuatable to undergo rotational movement in clockwise and counterclockwise directions and horizontal and vertical directions relative to said mobile chassis so as to change the elevation of an upper end portion of said lift mechanism above the ground; and an attachment mechanism supported by said upper end portion of said lift mechanism, said attachment mechanism comprising a forward component attached to and disposed rearwardly of an advertising display mounting frame, said forward component comprising a pair of rearwardly-projecting elongated tubular members being laterally spaced apart and extending fore-and-aft and parallel to one another, said elongated tubular members having forward ends, and a mounting structure having a front side and a rear side, said mounting structure attached at said rear side to said forward ends of said tubular members, said mounting structure being configured at said front side to detachably attach to the advertising display mounting frame, said mounting structure further comprising a main body portion and a pair of spaced-apart right and left vertical brace members extending upwardly and downwardly from said main body portion, said main body portion at said rear side of said mounting structure being attached to said forward ends of said tubular members, said spaced-apart vertical brace members having a front side and a plurality of plates attached on, and projecting forwardly from, said front side of said spaced-apart vertical brace members, said plates attached to a laterally-extending upper frame segment, a laterally-extending lower frame segment, and a pair of vertically-extending spaced apart interior frame segments of said advertising display mounting frame, and a rearward component attached to said upper end portion of said lift mechanism, said rearward component comprising a pair of forwardly-projecting tines configured to slidably insert into said rearwardly-projecting elongated tubular members of said forward component such that said forward and rearward components interfit with one another so as to attach with and detach from one another to correspondingly couple and decouple the advertising display mounting frame to and from said upper end portion of said lift mechanism.

14. A mobile aerial advertising display apparatus, comprising a ground-supported mobile chassis;

a lift mechanism comprising a telescopic upright channel structure mounted to said mobile chassis and being actuatable to change the elevation of an upper end portion of said lift mechanism above the ground; and an attachment mechanism supported by said upper end portion of said lift mechanism, said attachment mechanism comprising a forward component attached to and disposed rearwardly of an advertising display mounting frame, said forward component comprising a pair of rearwardly-projecting elongated tubular members being laterally spaced apart and extending fore-and-aft and parallel to one another, said elongated tubular members having forward ends, and a mounting structure having a front side and a rear side, said mounting structure attached at said rear side to said forward ends of said tubular members and configured at said front side to detachably attach to the advertising display mounting frame, said mounting structure further comprising a main body portion and a pair of spaced-apart right and left vertical brace members extending upwardly and downwardly from said main body portion, said main body portion at said rear side of said mounting structure being attached to said forward ends of said tubular member, said spaced-apart vertical brace members having a front side and a plurality of plates attached on, and projecting forwardly from, said front side of said spaced-apart vertical brace members, said plates attached to a laterally-extending upper frame segment, a laterally-extending lower frame segment, and a pair of vertically-extending spaced apart interior frame segments of said advertising display mounting frame, and a rearward component attached to said upper end portion of said lift mechanism, said rearward component including a pair of forwardly-projecting tines configured to slidably insert into said rearwardly-projecting elongated tubular members of said forward component such that said forward and rearward components interfit with one another so as to attach with and detach from one another to correspondingly couple and decouple the advertising display mounting frame to and from said upper end portion of said lift mechanism.

15. A mobile aerial advertising display apparatus, comprising a ground-supported mobile chassis;

a lift mechanism comprising a telescopic upright channel structure mounted to said mobile chassis and being actuatable to change the elevation of an upper end portion of said lift mechanism above the ground; and an attachment mechanism supported by said upper end portion of said lift mechanism, said attachment mechanism comprising a forward component attached to and disposed rearwardly of an advertising display mounting frame, said forward component comprising a pair of rearwardly-projecting elongated tubular members being laterally spaced apart and extending fore-and-aft and parallel to one another, a rearward component attached to said upper end portion of said lift mechanism, said rearward component comprising a pair of forwardly-projecting tines configured to slidably insert into said rearwardly-projecting elongated tubular members of said forward component such that said forward and rearward components interfit with one another, and a plurality of fasteners insertable through a plurality of apertures defined in said tubular members of said forward component and a plurality of apertures defined in said tines of said rearward component, and aligned with said plurality of apertures defined in said tubular members, such that when said tubular members and tines are interfitted with one another said forward and rearward components are adapted by said fasteners to attach with and detach from one another to correspondingly couple and decouple the advertising display mounting frame to and from said upper end portion of said lift mechanism.

* * * * *